United States Patent [19]

Kurz, deceased et al.

[11] 4,006,267

[45] Feb. 1, 1977

[54] COLOR HIGHLIGHTING PROCESS

[75] Inventors: Philip Kurz, deceased, late of Columbus, Ohio; by Jessie M. Kurz, executrix, Rockhill, S.C.

[73] Assignee: Xerox Corporation, Stamford, Conn.

[22] Filed: Nov. 19, 1974

[21] Appl. No.: 525,233

[52] U.S. Cl. ..... 427/14; 96/1.2; 427/56

[51] Int. Cl.² ..... G03G 13/00

[58] Field of Search ..... 427/24, 55, 56, 146, 427/148, 153, 342; 8/2.5, 2; 355/17; 96/1 R, 1.2

[56] References Cited

UNITED STATES PATENTS

| | | | |
|---|---|---|---|
| 2,755,200 | 7/1956 | Balon | 8/2.5 |
| 3,210,544 | 10/1965 | Marx et al. | 8/2.5 |
| 3,357,830 | 12/1967 | Bixby | 96/1.2 |
| 3,552,317 | 1/1971 | Ritzerfeld | 101/471 |
| 3,664,869 | 5/1972 | Sala | 427/153 |
| 3,764,309 | 10/1973 | Tamai et al. | 101/466 |
| 3,806,339 | 4/1974 | Tamai | 96/1 LY |
| 3,813,218 | 5/1974 | de Plasse | 8/2.5 |
| 3,814,790 | 6/1974 | Kato et al. | 427/148 |
| 3,829,286 | 8/1974 | Anzai et al. | 8/2.5 |
| 3,877,964 | 4/1975 | Orman | 8/2.5 |

*Primary Examiner*—Bernard D. Pianalto

[57] ABSTRACT

Conversion of selected image portions of a black and white xerographic copy into color portions is accomplished by applying a donor sheet, having a colorant in a resin binder coated thereon, to the image portions and thereafter heating the donor. Upon stripping the donor from the xerographic copy, the toner in the image portions of the xerographic copy acquire a surface layer of the colored composition from the donor sheet thereby resulting in a color highlighting of the image. The use of a nonthermoplastic binder resin material having a melting point of above 250° F is necessary to insure the nontransfer of the color composition to background areas of the xerographic copy.

10 Claims, 3 Drawing Figures

COLOR HIGHLIGHTING PROCESS

BACKGROUND OF THE INVENTION

This invention relates to methods of making color copies by a thermal color transfer process and more particularly to methods of producing color highlighted original documents from xerographic copies.

The manner of obtaining an electrostaticallly imaged copy is well known in the prior art and may be carried out in several ways; for instance, it is described in U.S. Pat. Nos. 2,397,691 and 2,357,809 to Carlson. The method generally followed comprises: (1) electrostatically charging a photosensitive plate; (2) imaging the charged plate by means of actinic radiation which results in dissipation of the charge in the exposed area and an electrostatic image in the unexposed portions of the plate; (3) developing the latent electrostatic image with a pigmented resin powder carrying an opposite electrostatic charge to that on the latent images whereby the powder is attracted and held in image form on the charged area; (4) transferring the image from the imaged plate to a copy sheet by mechanical or electrical means; and (5) fixing the powdered image on the copy sheet by means of heat or chemical treatment.

In U.S. Pat. No. 3,057,720 to Hayford et al., a method for xerographic color reproduction is disclosed. In xerographic reproduction the same basic xerographic steps as outlined above are utilized in combination with the well known subtractive principle of mixing primary colors. According to this principle, three primary colors; namely, green, red and blue, are reproduced by mixtures of the three complementary colors, referred to as subtractive primary colors; namely, magenta, cyan and yellow. According to this subtractive system, a magenta colored material is characterized by a substantially complete absorption of the primary color green and thus may be designated as green negative; cyan material characterized by substantially complete absorption of the color red; and a yellow material is characterized by a substantially complete absorption of the primary color blue. Utilizing this principle along with the basic xerographic process outlined above, three primary color exposures and three complementary color developments in registration will result in a full-color xerographic reproduction. This process is more fully outlined in the subject patent to Hayford et al.

The introduction of color xerography has made the production of color copy possible. Therefore, the option of reproducing a color original or making a color copy by limiting or changing development sequence are both possible. Therefore, a typewritten letter may be copied to have the typed characters appear green, red or blue. However, the only means presently available for reproducing some designated portion of an original in color (i.e., highlighting) is to have a color highlighted original. In the case of typewritten letter copy, this is significantly difficult and cumbersome inasmuch as certain letters or words would have to be typed in a color while others appear black and white.

Generally, the formation of color highlighted originals for use in color xerographic reproduction processes requires some means of transferring color to a given area of a document. In the case of a typewritten page, a transfer sheet, in the form of a tape or strip, having a flexible foundation and a coating of transferable material comprising essentially a wax-like vehicle having suspended therein a colorant and the original sheet are superimposed and subjected to a localized imaging force in the form of pressure or heat. When using a stripping material having a sheet of a transferable color composition, there is difficulty in isolating compatible and discrimminating materials which will color designate or print portions as desired. Otherwise, the color portions will transfer to undesirable areas such as the background area of a letter. In the case of a typewritter force utilizing a tape, such a procedure is cumbersome and time consuming.

The present invention relates to a color producing material employed to highlight image portions of a xerographic copy so that a color highlight original is available for xerographic color reproduction.

SUMMARY OF THE INVENTION

According to the present invention a colored donor is provided for thermal application to an image portion of a xerographic copy for purposes of color highlighting said portion. The colored donor is generally in the form of a sheet strip which includes a coating of a colorant in a nonthermoplastic resin binder material. The coating composition of the donor is applied to the surface of a portion of a xerographic copy in face-to-face contact so that upon heating a bond is formed between the tackified toner imaged area of the xerographic copy and the color coating on the donor. The toner imaged area of the xerographic copy having been made actively adhesive by heating adheres to the color coating of the donor with the result that when the donor is removed or stripped from the copy sheet the image portions of the xerographic copy adhesively cling to the colorant coating of the donor thereby resulting in a color layer formation on the image portion of the copy.

In summary, the present invention relates to a method of color highlighting an image portion of a xerographic copy comprising: (a) applying a colored transfer donor including a colorant and a nonthermoplastic resin binder in face-to-face contact with an image portion of a xerographic copy; (b) thermally activating the xerographic image; and (c) removing the transfer donor whereby the color is transferred to the image portion of the xerographic copy.

In one embodiment of the instant invention a donor sheet comprising a layer of elastomeric material and a coating of a colorant in a polyvinylpyrrolidone film forming resin binder is provided. The colorant coating of the donor strip is placed face to face together with a portion of an image of a xerographic copy. The sheet of paper bearing the xerographic image is heated while the coated donor sheet is pressed into contact with the image. Alternatively, the stripout donor may be "ironed" with a hot iron onto the xerographic image. In either case, the heating is maintained for a period of between 5 and 60 seconds while the temperature is kept between about 130°-250° F. Subsequently, the donor sheet is stripped from the xerographic copy whereby the colorant resin composition remains behind on the image portions of the xerographic copy resulting in a color highlighted image.

BRIEF DESCRIPTION OF THE DRAWINGS

Additional features and advantages of the present invention will hereinafter appear in the following drawings.

DETAILED DESCRIPTION OF THE DRAWINGS

Figure 1:
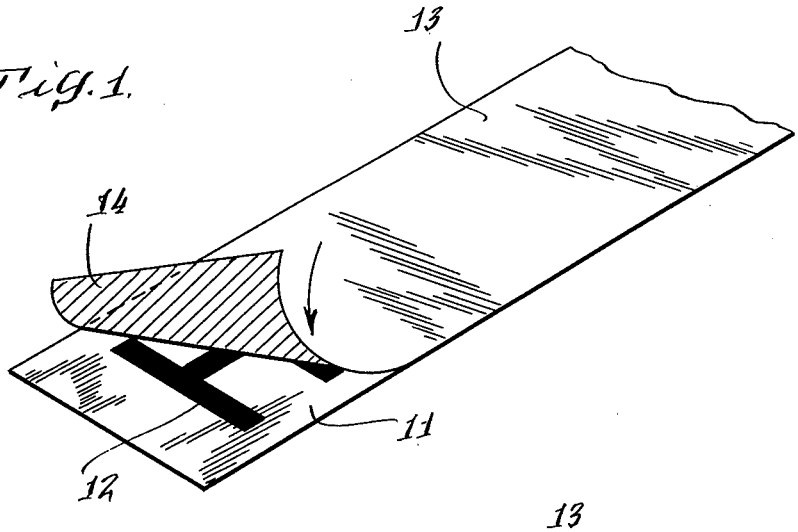
FIG. 1 is a diagrammatic perspective illustrating the electroscopic powder image formed on a plate with a donor sheet being placed thereon.

Referring now to the drawings in which like reference numbers refer to the same part and particularly to FIG. 1, the visible electrostatic image has been formed on a substrate 11 such as paper. A donor sheet 13 having a layer of coloring composition 14 hereinafter referred to as a transfer layer is superimposed over a portion of the xerographic copy. Within the purview of the present invention the colored layer 14 of donor sheet 13 is compatible with the toner 12 of the imaged surface to the extent that it will adhere to the surface of the tackified toner image and be removed therewith when heat is applied and the transfer sheet is separated from the xerographic copy 11.

The slight compatibility of the electroscopic powders or toners for the transfer donor color coating is due in part to the adhesive characteristics of the powders which are thermoadhesive resins such as rosin, gum copal, gum sandarac, cumarone-indene resin, the treated pine resin sold under the trademark "Vinsol" resin, ethyl cellulose or Egytian asphalt or any other material which has the required electroscopic properties. Moreover, the above-named materials in the presence of a thermal activating means will become tacky and bond to the transfer layer 14 of the donor sheet.

As mentioned above, according to the instant process a sheet of paper bearing a xerographic image or images is heated while a coated donor sheet bearing a stripable layer of colored composition is pressed into contact with the image. Alternatively, the stripout donor sheet may be "ironed" with a hot iron onto the xerographic image and thereafter stripped. To insure transfer of color to the xerographic image only, with no coloration of background or nonimage areas, it is necessary that the donor coating not melt in the range of temperatures utilized in the process. Generally, temperatures of from about 150°–250° F. are utilized in the process of this sort and therefore the coating composition should not melt in this range. To this end it is essential that the binder in the colored donor coating be nonthermoplastic and have only a limited compatibility with the thermoplastic components of the xerographic toners. The latter feature is necessary to minimize intermelting and depreciable change in the color of the donor coatings at it intermixes with the carbon black in the toner image.

As is demonstrated above the transfer color coating on the donor includes a colorant, in the form of a pigment or dye, in combination with a resin binder material. Binder materials having the requisite melting characteristics and limited compatibility include polyvinylpyrrolidone (PVP), vinyl butyral resin, substituted cellulose derivatives, and vinyl chloride-vinyl acetate copolymer resins. The cellulose derivatives include the cellulose ethers, ethyl cellulose, hydroxypropyl cellulose, and ethyl hydroxyethyl cellulose. Optimum results have been achieved with polyvinylpyrrolidone (PVP) as the film forming binder. Four different grades of PVP ranging in molecular weight from 10,000 PVP-H15, 40,000 PVP-830, 160,000 PVP-K60, and 360,000 PVP-K90, all supplied by General Aniline & Film Corporation, have been used with essentially identical excellent results as binders. It has been found that thermal stripout donor sheets based on PVP exhibit a wide "window"; that is, neither the temperature nor the time involved in the thermal transfer process is critical. For example, excellent color highlighting results whether the temperature of transfer is as low as 180° F. or as high as 220° F. and transfer times are as short as 6 seconds or as long as 60 seconds. It has also been found that in no case will the highlighting material transfer to paper inasmuch as the PVP binder is nonthermoplastic.

The colorant used in combination with the binder in the coating on the transfer donor may be any type of colorant which effectively colors or tints the portion of the xerographic image to which it is applied. Among the colorants which may be used include pigments such as Ultramarine Blue I-805, ferricoxide ($Fe_2O_3$), chrome green light, ferro yellow, and cadmium lithopone. These pigments may be lightened in shade by a mixture with titanium dioxide pigment. Another form of colorant that may be used within the purview of the present invention is dyed titanium dioxide. A complete listing of colorants is outlined in the examples.

The suitable activating means within the purview of the instant invention is the use of overall heat as for instance provided by a hot plate, heated rollers, heat lamps or an "ironing" process. According to this aspect of the instant invention, the heat provided should be sufficiently high to soften the electroscopic resin images and fuse them to the colorant coating on the donor, but not sufficiently high to melt the color coating composition. In general, temperatures within the range of 120° to 220° F. are satisfactory. However, the higher temperatures are preferred (for instance, in excess of about 190° F.) in order to render the toner images very tacky and enhance their adhesive attraction for the colorant coating layer on the donor. As mentioned above, because such temperatures are used it is necessary to use certain resin binder materials in the color coating layer.

The amount of pigment to be utilized in the transfer donor color layer is not critical within the purview of the present invention. Therefore, it has been found that pigment/binder weight ratios may range from about 5/1 up to about 40/1. A preferred ratio is about 20/1.

Figure 2:
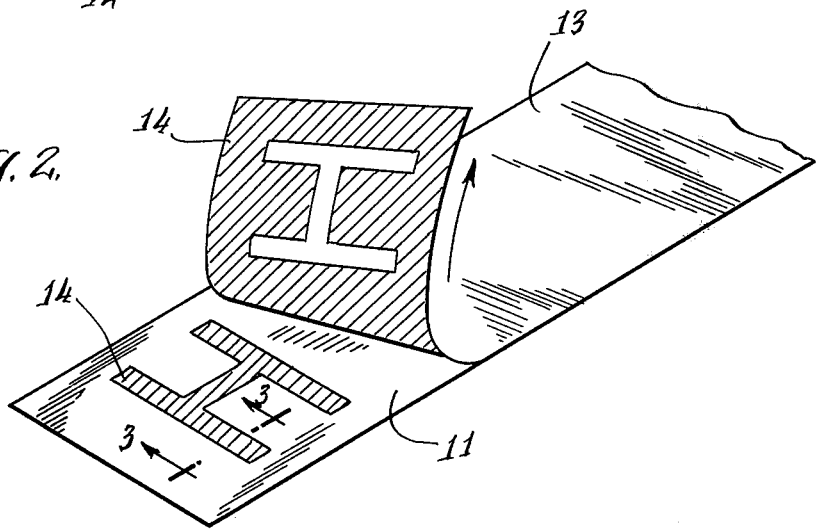
FIG. 2 is a diagrammatic perspective illustrating the transfer of the colorant composition from the donor onto the imaged portions of the xerographic copy.

In the actual practice of the instant invention, the donor transfer sheet 13 is applied to a selected portion 12 of a xerographic copy 11 as shown in FIG. 1. Heat is then applied either to transfer donor 13 by means of "ironing" or the xerographic copy itself is heated. After the image on the surface of the transfer donor sheet has become sufficiently tacky, the transfer and donor sheets form an adherent bond between the color coating layer 14 and the toner image 12 on the xerographic copy. Upon removing or stripping donor element 13 from the effected xerographic portion a highlighted image results as is illustrated in FIG. 2. A portion of the color coating is completely removed corresponding to the portion of the xerographic image which is highlighted by color.

As previously demonstrated, under the effects of heat the electroscopic toner images become tacky due to the absorption of the heat and fuse to the color coating of the donor which is in face-to-face contact with same.

Figure 3:
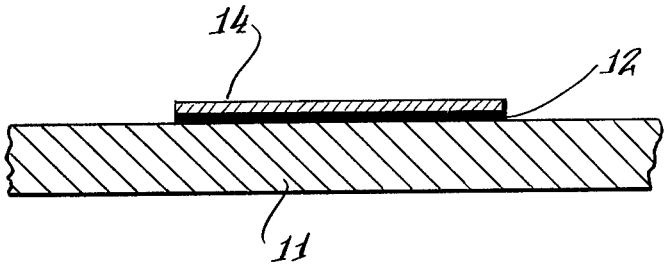
FIG. 3 is a diagrammatic section illustrating the highlighted image including the colorant composition bonded to the toner image.

Upon separation or stripping of the donor from the xerographic image, an excellent color highlighted original sheet is provided as exemplified in FIG. 3 of the drawing. Note that the color composition forms an independent layer upon the electroscopic toner material thereby rendering it color highlighted in the image areas.

Regarding the substrate to be used for the color coating 14 of the transfer donor 13, any material may be utilized to accomplish the purpose of transferring the color composition. Generally, flexible materials such as paper and elastomeric resins are preferred. Most appropriate are polyester and polycarbonate films such as Mylar, manufactured by duPont Corp. and Lexan, manufactured by the General Electric Co.

As mentioned above, generally a small amount of pressure is applied between the donor and the xerographic image to which it is applied. The amount of pressure necessary to accomplish sufficient bonding will vary also depending on many factors such as the particular coating on the donor, the conditions of the tackified image, the particular toner material employed, a delay before placing the softened and tacky toner image into the pressure assembly, humidity and other atmospheric conditions, and the like.

DESCRIPTION OF SPECIFIC EMBODIMENTS

I. Preparation of Coating Mixtures

Coating mixtures for preparing donor sheets for thermal transfer color highlighting are generally prepared by utilizing a shaker to disperse the pigment or by milling the components. In the case of milling it is sufficient generally to mill the pigments for 10 to 20 minutes in a device such as a paint shaker using a metal can to confine the components of the mixture and stainless steel balls to provide attrition. When a ball mill is used usually at least 4 hours of milling is recommended. In preparing the coating it is preferred to dissolve the binder listed below in the solvent-vehicle before mixing with the pigment. Typical coating mixture compositions are in parts by weight and are as follows:

| | | | | |
|---|---|---|---|---|
| Dyed-Resin Fluorescent Pigments | | | | |
| Pigment/Binder Ratio | 40/1 | 20/1 | 10/1 | 5/1 |
| PVP-K90 (binder) | 0.5 | 1 | 2 | 4 |
| HI-VIZ Strong Red B2836 (pigment) | 20 | 20 | 20 | 20 |
| Ethanol (solvent-vehicle) | 56 | 56 | 48 | 48 |
| Pigment/Binder Ratio | 18/1 | 9/1 | | |
| PVP-K90 (binder) | 1 | 1 | | |
| Radiant Red P1600-515 (pigment)* | 18 | 9 | | |
| Ethanol (solvent-vehicle) | 36 | 18 | | |
| Pigment/Binder Ratio | 9/1 | | | |
| PVP-K90 (binder) | 1 | | | |
| Radiant Magenta P1700-618 (pigment) | 9 | | | |
| Ethanol (solvent-vehicle) | 18 | | | |
| Pigment/Binder Ratio | 100/1 | 49/1 | 10/1 | 9/1 |
| PVP-K90 (binder) | 1 | 1 | 1 | 1 |
| Radiant Pink P1700-617 (pigment) | 100 | 49 | 10 | 9 |
| Ethanol (solvent-vehicle) | 200 | 98 | 20 | 18 |
| Pigment/Binder Ratio | 50/1 | | | |
| Vinylite XYHL (binder) | 1 | | | |
| HI-VIZ Magenta B2854 (pigment) | 50 | | | |
| Ethanol (solvent-vehicle) | 86.5 | | | |
| Pigment/Binder Ratio | 9/1 | | | |
| Vinylite XYHL (binder) | 1 | | | |
| HI-VIZ Strong Red B2836 (pigment) | 9 | | | |
| Ethanol (solvent-vehicle) | 18 | | | |
| Pigment/Binder Ratio | 9/1 | | | |
| Ethylcellulose N-10 (binder) | 1 | | | |
| HI-VIZ Strong Red B2836 (pigment) | 9 | | | |
| Ethanol (solvent-vehicle) | 18 | | | |
| Pigment/Binder Ratio | 9/1 | | | |
| Klucel J (binder) | 1 | | | |
| HI-VIZ Strong Red B2836 (pigment) | 9 | | | |
| Ethanol (solvent-vehicle) | 18 | | | |
| Mineral Pigments (Undyed or Dyed) | | | | |
| Pigment/Binder Ratio | 9/1 | | | |
| PVP-K90 (binder) | 1 | | | |
| Ultramarine Blue I-805 (pigment) | 9 | | | |
| Ethanol (solvent-vehicle) | 18 | | | |
| Pigment/Binder Ratio | 20/1 | | | |
| PVP-K90 (binder) | 1 | | | |
| Titanium Dioxide (pigment) | 15 | | | |
| Cyan Green Toner 15-3100 (pigment) | 5 | | | |
| Ethanol (solvent-vehicle) | 40 | | | |
| Pigment/Binder Ratio | 17/1 | | | |
| PVP-K90 (binder) | 1 | | | |
| Titanium Dioxide (pigment) | 10 | | | |
| Cyan Green Toner 15-3100 (pigment) | 5 | | | |
| Ultramarine Blue I-805 (pigment) | 2 | | | |
| Ethanol (solvent-vehicle) | 40 | | | |
| Pigment/Binder Ratio | 17/1 | | | |
| PVP-K90 (binder) | 1 | | | |
| Titanium Dioxide (pigment) | 10 | | | |
| Ferric Oxide (pigment) | 5 | | | |
| Ultramarine Blue I-805 (pigment) | 2 | | | |
| Ethanol (solvent-vehicle) | 40 | | | |
| Pigment/Binder Ratio | 10/1 | 15/1 | 20/1 | |
| PVP-K90 (binder) | 1 | 1 | 1 | |
| Titanium Dioxide (pigment) | 10 | 15 | 20 | |
| Alphazurine 2G (dye) | 1 | 1 | 1 | |
| Ethanol (solvent-vehicle) | 40 | 40 | 40 | |
| Pigment/Binder Ratio | 10/1 | 10/1 | 15/1 | |
| PVP-K90 (binder) | 1 | 1 | 1 | |
| Titanium Dioxide (pigment) | 10 | 10 | 15 | |

-continued

| | | | |
|---|---|---|---|
| Calcocid Phloxine 2G (dye) | 1 | 1.5 | 1.9 |
| Acid Magenta 0 | 1 | 0.5 | 0.1 |
| Ethanol (solvent-vehicle) | 40 | 40 | 40 |
| Dyed Nonfluorescent Organic Pigments | | | |
| Pigment/Binder Ratio | 20/1 | | |
| PVP-K90 (binder) | 1 | | |
| Geon 135 (pigment) | 20 | | |
| Brilliant Blue J (dye) | 0.25 | | |
| Ethanol (solvent-vehicle) | 40 | | |
| Pigment/Binder Ratio | 20/1 | | |
| PVP-K90 (binder) | 1 | | |
| Geon 135 (pigment) | 20 | | |
| Calcocid Phloxine 2G (dye) | 0.25 | | |
| Ethanol (solvent-vehicle) | 40 | | |

*Radiant Blue P1600-519 and Radiant Green P1600-511 also used in place of Radiant Red P1600-515 in 18/1 and 9/1 mixtures.

II. Preparation of the Donor Sheets

The coating mixtures, prepared as described above, were used to coat 2-mill Mylar sheets which serve as substrate supports for the donor coatings. In the coating process, a bead of coating mixture was applied to the horizontally positioned sheet near one end. Then, with a wire wound draw down rod (numbers 14, 24, and 36 were used) the coating mixture was spread over the length of the sheet. In the case of ethanol as the solvent vehicle it was found that air drying of the coatings for 20 minutes at room temperature was sufficient.

III. Thermal Transfer

The colored donor sheets prepared as described above can be used in two modes of thermal transfer processes to produce a color highlighted xerographic image. In the first mode the donor sheet is pressed against a heated sheet of paper bearing a xerographic image. In this process, the xerographic copy is generally placed on a source of heat such as an electric hot plate which is regulated at temperatures between 180°–220° F. In the second mode, the paper bearing the xerographic image is placed on a flexible support, covered with the donor sheet prepared above, and heat is applied through the back of the donor by means of an electrically heated iron operated at between temperatures of 150°–220° F. In both cases separation of the donor material from the xerographic image results in a color highlighting of that portion of the xerographic copy. The main differences between the two is that heating the xerographic copy generally results in quicker transfer, i.e., in 1 second or less. Transfer is achieved from 7 to 10 seconds utilizing the iron to heat the back of the donor.

While the present invention has been described and carried out in terms of specific embodiments thereof, it is not the intention to be so limited thereby, but is intended to cover the invention broadly within the spirit and scope of the appended claims.

What is claimed is:

1. A method of color highlighting an image portion of a xerographic copy comprising:

a. applying a colored transfer donor including a substrate and a layer of colorant in a nonthermoplastic resin binder in face-to-face contact with an image portion of a xerographic copy;

b. thermally activating the xerographic image by causing it to be heated for 5 to 60 seconds within a temperature range of from about 130° to 250° F; and c. removing the transfer donor to transfer the color of the donor layer to the image portion of the xerographic copy.

2. The method of claim 1 wherein the colorant is a pigment.

3. The method of claim 1 wherein thermal activation occurs by applying heat to the transfer donor.

4. The method of claim 1 wherein thermal activation occurs by heating the xerographic copy.

5. The method of claim 1 wherein the substrate is a flexible elastomeric material.

6. The method of claim 1 wherein the nonthermoplastic resin has a melting point above 250° F.

7. The method of claim 1 wherein the nonthermoplastic resin is selected from the group consisting of polyvinylpyrrolidone and substituted cellulose ethers.

8. The method of claim 7 wherein the nonthermoplastic resin is polyvinylpyrrolidone.

9. The method of claim 8 wherein the pigment and binder are in a weight ratio of from about 40/1 to 5/1.

10. The method of claim 9 wherein the weight ratio of pigment/binder is 20/1.

* * * * *

Disclaimer 4,006,267.—*Philip Kurz,* deceased, late of Columbus, Ohio; by Jessie M. Kurz, executrix, Rockhill, S.C. COLOR HIGHLIGHTING PROCESS. Patent dated Feb. 1, 1977. Disclaimer filed Jan. 22, 1985, by the assignee, *Xerox Corp.*

Hereby enters this disclaimer to claims 1 through 10, inclusive of said patent.

[*Official Gazette April 9, 1985.*]